US009244430B2

(12) United States Patent
Uchida et al.

(10) Patent No.: US 9,244,430 B2
(45) Date of Patent: Jan. 26, 2016

(54) IMAGE FORMING APPARATUS ENSURING FILTRATION OF OZONATED AIR

(71) Applicant: Brother Kogyo Kabushiki Kaisha, Nagoya (JP)

(72) Inventors: Norio Uchida, Nagoya (JP); Akihiro Torii, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/301,558

(22) Filed: Jun. 11, 2014

(65) Prior Publication Data

US 2014/0369710 A1 Dec. 18, 2014

(30) Foreign Application Priority Data

Jun. 12, 2013 (JP) ..... 2013-123345

(51) Int. Cl.
*G03G 21/00* (2006.01)
*G03G 21/20* (2006.01)
*G03G 15/02* (2006.01)

(52) U.S. Cl.
CPC ..... *G03G 21/206* (2013.01); *G03G 15/0258* (2013.01); *G03G 21/0052* (2013.01); *G03G 2221/1645* (2013.01)

(58) Field of Classification Search
CPC . G03G 21/20; G03G 21/206; G03G 15/0258; G03G 21/0052; G03G 2221/1645
USPC ..... 399/92–94
See application file for complete search history.

(56) References Cited

U.S. PATENT DOCUMENTS

| | | | | |
|---|---|---|---|---|
| 2005/0078976 | A1* | 4/2005 | Deguchi et al. | 399/92 |
| 2007/0071484 | A1* | 3/2007 | Igarashi | 399/92 |
| 2010/0129111 | A1 | 5/2010 | Tamura | |
| 2011/0217066 | A1* | 9/2011 | Ukai | 399/93 |
| 2012/0087693 | A1* | 4/2012 | Yamaguchi et al. | 399/92 |
| 2012/0107010 | A1* | 5/2012 | Hata | 399/92 |

FOREIGN PATENT DOCUMENTS

| | | |
|---|---|---|
| JP | 2010-128053 A | 6/2010 |
| JP | 2011-142403 A | 7/2011 |

* cited by examiner

*Primary Examiner* — Clayton E LaBalle
*Assistant Examiner* — Trevor J Bervik
(74) *Attorney, Agent, or Firm* — Burr & Brown, PLLC

(57) ABSTRACT

An image forming apparatus is provided with a casing, a drum unit including a photoconductive drum having a central axis extending in a first direction, and a charging device configured to charge the photoconductive drum, a fixing unit configured to fix an image on a printing medium, a fan configured to generate an air flow inside the casing, a filter configured to remove ozone included in the air, a first channel defined in the casing, the air directed from the fixing unit toward the fan flowing in the first channel, a second channel defined in the casing, the air directed from the charging device toward the fan flowing in the second channel, the filter being provided in the second channel, the second channel being arranged next to the first channel, and a blocking member configured to block communication between the first channel and the second channel.

19 Claims, 4 Drawing Sheets

IMAGE FORMING APPARATUS ENSURING FILTRATION OF OZONATED AIR

CROSS-REFERENCE TO RELATED APPLICATION

This application claims priority under 35 U.S.C. §119 from Japanese Patent Application No. 2013-123345 filed on Jun. 12, 2013. The entire subject matter of the Japanese application is incorporated herein by reference.

BACKGROUND

1. Technical Field

Aspects of the present invention relate to an image forming apparatus employing an electrophotographic image forming method.

2. Prior Art

Conventionally, an image forming apparatus employing an electrophotographic image forming method has been known. Such an apparatus is generally configured such that a charged surface of a photoconductive drum is exposed to light which is modified based on image information to form an electrostatic latent image, toner is applied on the latent image to develop an image, the developed image is transferred on a recording sheet, and the transferred image is fixed by applying heat and pressure.

Such an apparatus has a fixing unit to fix the image on the sheet. The fixing unit typically has a heat roller and a pressure roller. The sheet on which the toner image has been transferred is caused to pass through a nip between the heat roller and the pressure roller, the heat and pressure are applied to the image, thereby the toner image is fixed on the sheet.

SUMMARY

The heat roller has a heating element inside the roller. Since a temperature of a surrounding area of the heat roller is raised, the image forming apparatus typically has a ventilation fan to ventilate the air inside the apparatus so that the temperature inside the apparatus does not increase excessively.

Such an image forming apparatus generally has a charging device which is used to charge the circumferential surface of the photoconductive drum. When the charging device is activated, ozone is generated. Therefore, the electrophotographic image forming apparatus generally has a filter to prevent the ozone from being discharged from the apparatus.

However, in the fixing unit, an airflow directed to the ventilation fan is generated, and the ozone generated at the charging device may be directed to the ventilation fan due to the air flow. In such a case, the air including the ozone does not pass through the filter, and thus the ozone may be discharged outside the apparatus.

In consideration of the above, aspects of the invention are advantageous in that an electrophotographic image forming apparatus is capable of removing ozone appropriately from the air discharged from the apparatus.

According to aspects of the invention, there is provided an image forming apparatus, which is provided with a casing, a drum unit including a photoconductive drum having a central axis extending in a first direction, and a charging device configured to charge the photoconductive drum, a fixing unit arranged adjacent to the drum unit and configured to fix an image on a printing medium, a fan configured to generate an air flow inside the casing, a filter configured to remove ozone included in the air passing therethrough, a first channel defined in the casing, the air directed from the fixing unit toward the fan flowing in the first channel, a second channel defined in the casing, the air directed from the charging device toward the fan flowing in the second channel, the filter being provided in the second channel, the second channel being arranged next to the first channel, and a blocking member configured to block communication between the first channel and the second channel.

With the above configuration, communication between the first channel and the second channel can be blocked by the blocking member. Therefore, joining of the air flowing in the first channel and the air flowing in the second channel can be well suppressed. Further, since the filter is provided in the second channel, the ozone can be removed from the air by simply causing the air to flow in the second channel.

According to aspects of the invention, there is provided an image forming apparatus, which is provided with a main body casing, a drum unit including a photoconductive drum having a central axis extending in a first direction, and a charging device configured to charge the photoconductive drum. Ozone may be generated when the charging device is activated. The image forming device further includes a fixing unit arranged adjacent to the drum unit and configured to fix an image on a printing medium. The fixing unit includes a heat generating member, a fan configured to generate an air flow inside the main body casing. The image forming apparatus further includes a filter configured to remove the ozone included in the air passing therethrough, a first channel defined in the main body casing, the air directed from the fixing unit toward the fan flowing in the first channel, the air flow in the first channel suppressing increase of temperature of the air around the fixing unit, a second channel defined in the main body casing, the air directed from the charging device toward the fan flowing in the second channel, the air including the ozone being caused to flow in the second channel, the filter being provided in the second channel, and a blocking member configured to block the air flowing in the second channel from entering the first channel.

According to aspects of the invention, there is provided an image forming apparatus, which has a plurality of drum units arranged at intervals in a predetermined direction. Each drum unit has a photoconductive drum having a central axis extending in a second direction perpendicular to the predetermined direction and a charging device configured to charge the photoconductive drum, the charging device having a charger frame. The image forming apparatus further includes a fixing unit configured to fix an image on a printing medium and arranged adjacent to the plurality of drum units in the predetermined direction, a main body casing accommodating the drum unit and the fixing unit therein and having an inner frame disposed between the drum unit and the fixing unit in the predetermined direction, and a flexible member having a first end portion and a second end portion opposite to the first end portion, the first end portion contact with the charger frame and the second end portion contact with the inner frame.

BRIEF DESCRIPTION OF THE ACCOMPANYING DRAWINGS

DETAILED DESCRIPTION OF THE EMBODIMENTS

<First Embodiment>

A printer 1 according to a first embodiment of the invention is a horizontally-placed, direct tandem type color printer.

Figure 1:
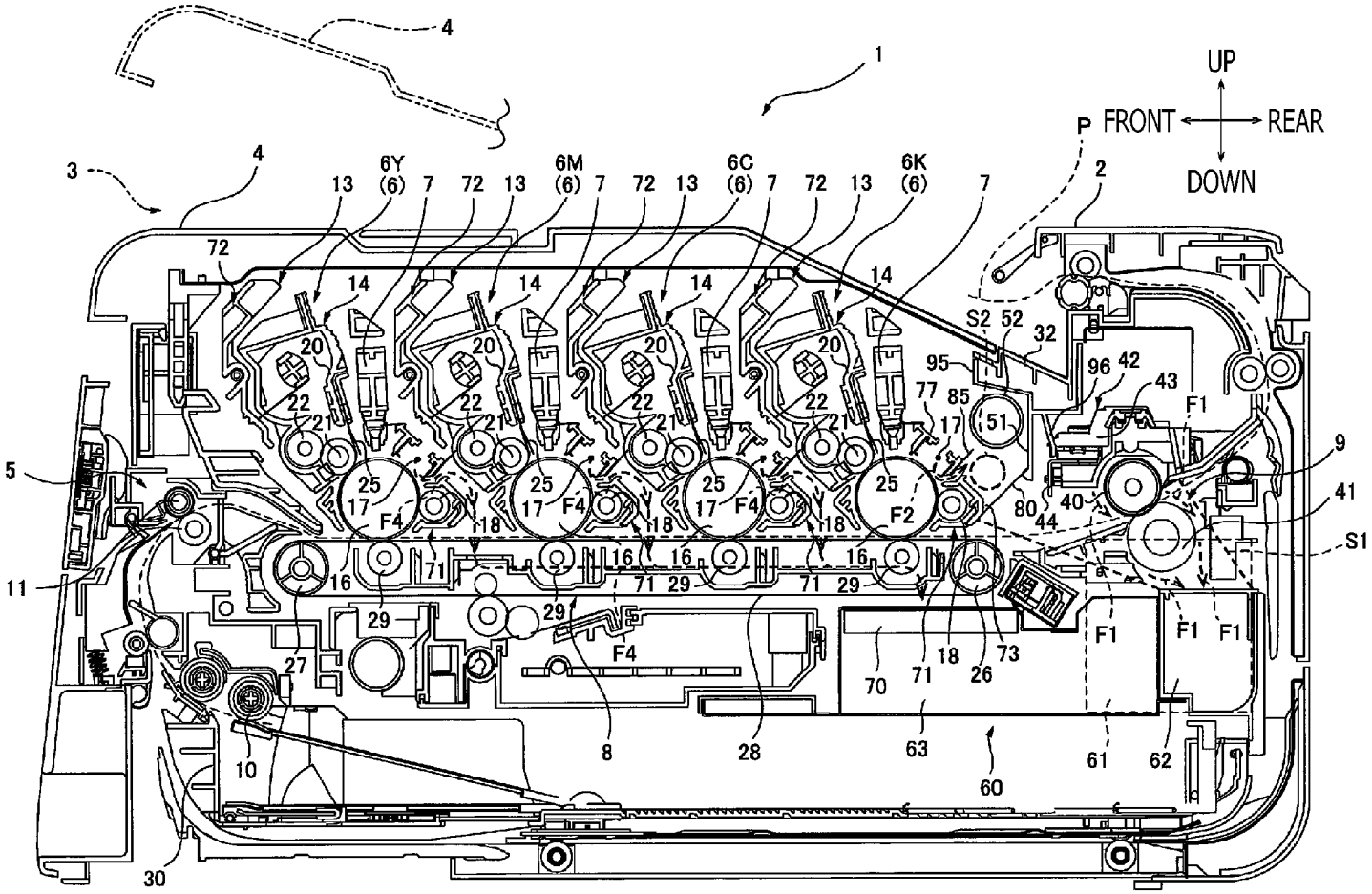
FIG. 1 is a cross-sectional side view of a printer according to a first embodiment of the invention.

In the following description, when directions with respect to the printer are referred to, the directions for a user when the printer 1 is placed horizontally will be used. For example, in FIG. 1, the up and down directions of FIG. 1 are the up-and-down directions of the printer 1. Further, the front and rear directions of the printer 1 are a right-hand direction and a left-hand direction of FIG. 1, respectively. Right and left directions are indicated with reference to the directions when the printer 1 is viewed from its front side. Therefore, a direction perpendicular to a plane of FIG. 1 is a right-and-left direction of the printer 1. Specifically, a further direction with respect to the plane of FIG. 1 is a left direction of the printer 1, and a nearer side with respect to the plane of FIG. 1 is a right direction of the printer 1.

The printer 1 has a substantially box-like main body casing 2, which has an opening 3, a top cover 4, a dividing wall 51 and an reinforcing member 52. In the specification, the main body casing 2 will be simply referred to as the casing 2.

The opening 3 is formed on an upper wall of the casing 2. The top cover 4 is configured to be rotatable about an axis defined on its rear end, and configured to be located between a close position (indicated by solid lines in FIG. 1) to close the opening 3 and an open position (indicated by phantom lines in FIG. 1) at which the top cover 4 does not close the opening 3.

A rear part of the top cover 4 is formed to have a substantial V-like recessed shape when viewed in the right-and-left direction. The V-like recessed part serves as a sheet discharge tray 32.

The dividing wall 51 has a substantially planar plate shape, and extends in the right-and-left direction over the entire width of the casing 2 in the right-and-left direction. The dividing wall 51 is arranged below the sheet discharge tray 32. The dividing wall 51 is arranged to extend in the up-and-down direction such that the dividing wall 51 divides a black process unit 6K (described later) and a fixing unit 9 (described later).

The dividing wall 51 has a first auxiliary wall 95 and a second auxiliary wall 96. The first auxiliary wall 95 is a substantially planar plate member extending in right-and-left direction corresponding to the entire width of the casing 2 in the right-and-left direction. The first auxiliary wall 95 extends from the dividing wall 51 and contacts the discharge tray 32. The second auxiliary wall 96 is a planar plate member extending in the right-and-left direction corresponding to the entire width of the casing 2 in the right-and-left direction. Second auxiliary wall 96 extends from the dividing wall 51 and contacts a fixing frame 42 (described later).

The reinforcing member 52 is a substantially cylindrical shape. The reinforcing member 52 is arranged on a rear side with respect to the black process unit 6K. Further, the reinforcing member 52 is arranged on a front side with respect to the dividing wall 51 with a space therebetween. The reinforcing member 52 is bridged between a right side and a left side of the casing 2 to reinforce the case.

The printer 1 has a sheet feeding unit 5, a plurality of (four, according to the embodiments) process units 6, a plurality of (four, according to the embodiments) LED units 7, and the fixing unit 9 inside the casing 2.

The sheet feeding unit 6 is arranged on a lower part of the casing 2. The sheet feeding unit 5 has a sheet tray 30 configured to accommodate printing sheets, a pickup roller 10 arranged above the sheet tray 30, and a pair of registration rollers 11 arranged above the pickup roller 10.

Figure 2:
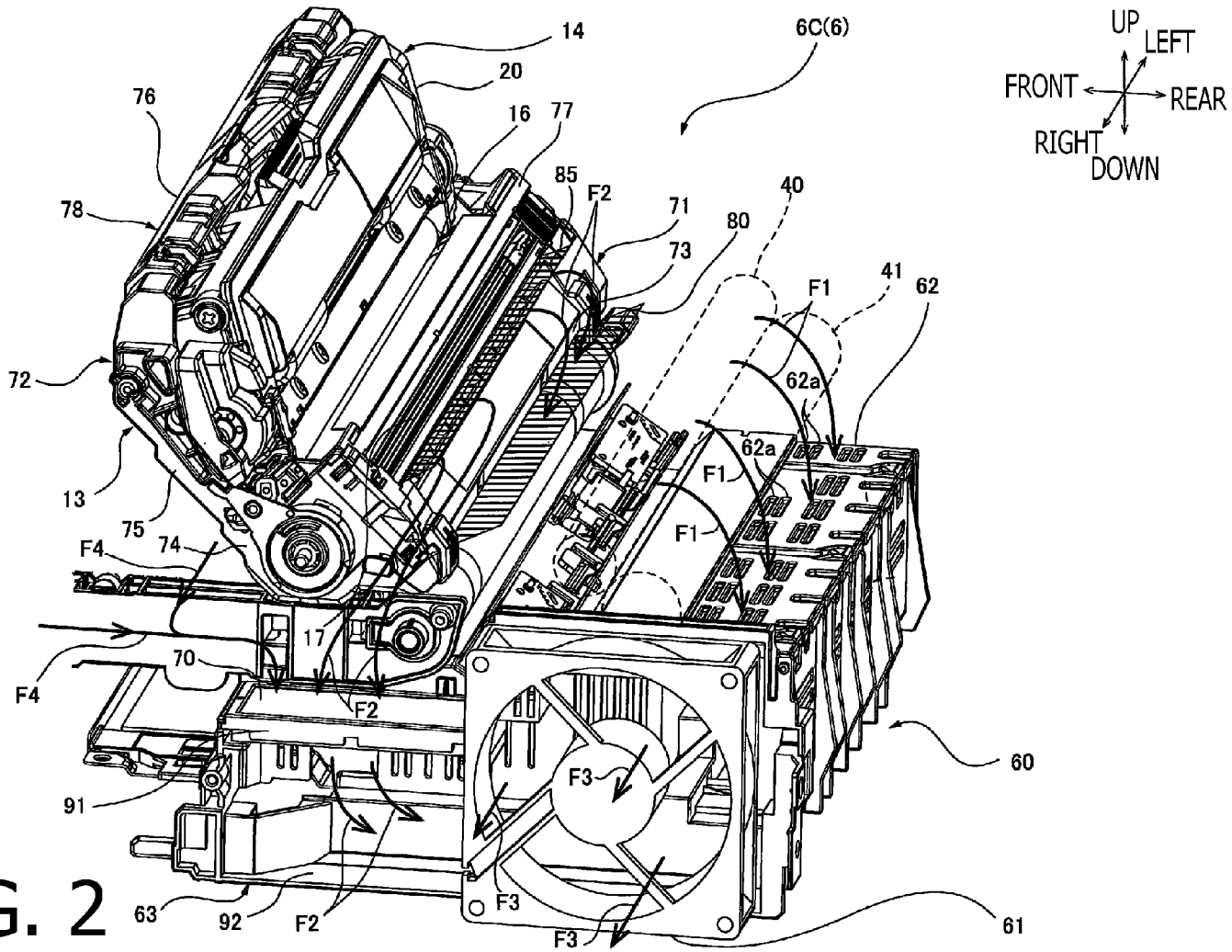
FIG. 2 is a perspective view showing a process unit, ventilation section and a second film of the printer shown in FIG. 1.

As shown in FIGS. 1 and 2, the plurality of process units 6 are arranged at a central part, in the front-and-rear direction, inside the casing 2 spaced from each other. The plurality of process units 6 are configured to be detachably attached to the printer 1. Specifically, the plurality of process units 6 are arranged such that upper end parts thereof are located below the top cover 4 (at the close position) and lower end parts thereof are located above a transferring unit 8 (described later).

The plurality of process units 6 correspond to colors of the toner, respectively. According to the embodiment, the colors of the toner are yellow, magenta, cyan and black, and the four process units 6 (i.e., a yellow process unit 6Y, a magenta process unit 6M, a cyan process unit 6C and a black process unit 6K) are arranged in this order from the front side to rear side. The plurality of process units 6 are configured to be detachable/attachable with respect to the casing 2 through the opening 3.

Each of the plurality of process units 6 (i.e., 6Y, 6M, 6C and 6K) has a drum cartridge 13 and a developing cartridge 14.

In each of the process units 6, the drum cartridge 13 has a drum frame 78, a photoconductive drum 16, a scorotron charger 17 and a cleaning roller 18.

The drum frame 78 has a drum container 71 and a developing cartridge container 72.

The drum container 71 has an upper front wall 77, a upper rear wall 73, a first film 85 and a pair of side walls 74.

The upper front wall 77 is a planar plate member extending in the right-and-left direction, and arranged to incline to extend from an upper front position to a lower rear position when viewed in the right-and-left direction.

The upper rear wall 73 extends in the right-and-left direction, and is substantially U-shaped when viewed in the right-and-left direction such that the upper rear wall 73 surrounds the cleaning roller 18. An upper end of the upper rear wall 73 is connected to a lower side of the upper front wall 77.

The first film 85 is a flexible resin film and has a substantially rectangular shape extending in the right-and-left direction when viewed in the up-and-down direction. A front end part of the first film 85 is secured to a position between the upper front wall 77 and the upper rear wall 73. A rear end part of the first film 85 is located at a lower front position with respect to the reinforcing member 52 with a space therebetween. The first film 85 is inclined such that the front end part is located at the lower front position and the rear end part is located at the rear upper position when viewed in the right-and-left direction.

One wall of the pair of side walls 74 is formed to extend in the front-and-rear direction and connected to right ends of the upper front wall 77 and the upper rear wall 73.

The other wall of the pair of side walls 74 is formed to extend in the front-and-rear direction and connected to left ends of the upper front wall 77 and the upper rear wall 73.

The developing cartridge container 72 has a pair of side walls 75 and a bottom wall 76.

Rear ends of the pair of side walls 75 are connected to front ends of the pair of side walls 74, respectively. Each of the pair of side walls 75 extends in the front-and-rear direction such that a portion closer to a front end thereof is located at an upper position.

The bottom wall 76 is connected to the lower ends of the pair of side walls 75 and bridged therebetween.

Each photoconductive drum 16 has a substantially cylindrical shape extending in the right-and-left direction. The photoconductive drum 16 is rotatably supported by the pair of side walls 74, and a lower end part thereof is exposed outside from the drum container 71.

The scorotron charger 17 is arranged at a rear above portion with respect to the photoconductive drum 16 with a space therebetween. The scorotron charger 17 extends in the right-and-left direction, and secured to the upper front wall 77.

The cleaning roller 18 has a substantially cylindrical shape extending in the right-and-left direction, and rotatably supported by a pair of side walls 74. The cleaning roller 18 is accommodated in a space defined by the upper rear wall 73 and the pair of side walls 74.

The developing cartridge 14 is detachably accommodated in a space defined by a pair of side walls 75 and bottom wall 76 inside the developing cartridge unit 72.

The developing cartridge 14 has a developing frame 20, a developing roller 21, a supplying roller 22 and a regulation blade 25.

The developing frame 20 has a box-like shape extending in the right-and-left direction, and accommodates toner therein.

The developing roller 21 is rotatably supported at a lower end part of the developing frame 20. A rear end part of the developing roller 21 is exposed to outside from the developing frame 20 and contacts the upper front part of the photoconductive drum 16.

The supplying roller 22 is arranged at an upper front position with respect to the developing roller 21. The supplying roller 22 is rotatably supported by the developing frame 20, and a lower rear part of the supplying roller 22 contacts the upper front part of the developing roller 21.

The regulation blade 25 contacts the rear end part of the developing roller 21, and is configured to regulate a thickness of the toner supplied onto the circumferential surface of the developing roller 21.

The plurality of LED units 7 are respectively arranged above the photoconductive drums 16 with spaces therebetween.

The transferring unit 8 is arranged below the plurality of process units 6. The transferring unit 8 has a driving roller 26, a driven roller 27, a conveying belt 28 and a plurality of transferring rollers 29.

The driving roller 26 is arranged below the photoconductive drum 16 of the black process unit 6K. The driving roller 26 is rotatably supported by the casing 2.

The driven roller 27 is arranged at a lower front position with respect to the photoconductive drum 16 of the yellow process unit 6Y. The driven roller 27 is rotatably supported by the casing 2.

The conveying belt 28 is arranged below the photoconductive drums 16 such that an upper part of the conveying belt 28 contacts each photoconductive drum 16. The conveying belt 28 is an endless belt which is wound around the driving roller 26 and the driven roller 27. As the driving roller 26 and the driven roller 27 rotates, the upper part of the conveying belt moves from the front side toward the rear side.

Each of the plurality of transferring rollers 29 is arranged below the corresponding one of the plurality of photoconductive drums 16 with the conveying belt 28 located therebetween. The plurality of transferring rollers 29 are rotatably supported by the casing 2. Each of the plurality of transferring rollers 29 contacts the lower part of the conveying belt 28.

The fixing unit 9 is arranged on the rear side of the black process unit 6K and the transferring unit 8. The fixing unit 9 has a heat roller 40, a pressure roller 41 and the fixing frame 42.

The heat roller 40 has a heating element (not shown) therein, and heats the printing sheet P with the heat generated by the heating element.

The pressure roller 41 is arranged on a lower rear position with respect to the heat roller 40. An upper front part of the pressure roller 41 contacts a lower rear part of the heat roller 40.

A relative position between the heat roller 40 and the pressure roller 41 is designed such that a line segment connecting a central axis of the heat roller 40 and the central axis of the pressure roller 41 is oriented in the same direction as a projecting direction from the fixing frame 42 to a duct 62.

The fixing frame 42 rotatably supports the heat roller 40 and the pressure roller 41. The fixing frame 42 has an upper cover 4 and a front cover 44.

The upper cover 43 is arranged above the heat roller 40 with a certain space therebetween. The upper cover 43 extends in the right-and-left direction such that it covers the upper part of the heat roller 44. Both right and left end parts of the upper cover 43 are fixed to the casing 2.

The front cover 44 is arranged in front of the heat roller 40 with a space therebetween. The front cover 44 has a plate-like member extending in the right-and-left direction. The front cover 44 is secured to a front end part of the upper cover 43.

Printing sheets P are accommodated in the tray 30, and the tray 30 is arranged at a bottom part of the casing 2. The printing sheets P are picked up one by one by the pickup roller 10 and conveyed such that the printing sheet P makes a U-turn. Further, the printing sheet P is conveyed toward an area between the photoconductive drums 16 and the conveying belt 28. Then, by the conveying belt 28, the printing sheet P is conveyed between the photoconductive drums 16 and the corresponding transferring rollers 29, from the front side toward the rear side.

The toner inside the developing frame 20 is positively charged by frictional electrification between the supplying roller 22 and the developing roller 21. The charged toner is supplied to the developing roller 21. As the developing roller 21 rotates, the regulation blade 25 regulates the thickness of the toner on the circumferential surface of the developing roller 21. As a result, the toner is carried on the circumferential surface of the developing roller 21 as a thin layer having a predetermined constant thickness.

As each photoconductive drum 16 rotates, the circumferential surface thereof is uniformly charged by a scorotron type charging device (hereinafter, referred to as a scorotron charger) 17. Thereafter, the charged surface of each photoconductive drum 16 is exposed to light which is modulated in accordance with image data and emitted by the LED unit 7. With this exposure operation, an electrostatic latent image corresponding to an image to be formed on the printing sheet P is formed on the circumferential surface of each photoconductive drum 16.

The toner positively charged and borne on the circumferential surface of the developing roller 21 is supplied to the latent image formed on the circumferential surface of each photoconductive drum 16 as it rotates further. Then, due to a reversal phenomenon, a toner image corresponding to the latent image is formed on the circumferential surface of each photoconductive drum 16.

Thereafter, when the printing sheet P passes through a portion between each photoconductive drum 16 and corresponding transferring roller 29, the toner image on each photoconductive drum 16 is transferred onto the printing sheet P due to a transferring bias applied to each transferring roller 29. The toner and/or paper particles residual on the circumferential surface of each photoconductive drum 16 are removed by the cleaning roller 18.

Heat and pressure are applied to the toner image formed on the printing sheet P when the printing sheet P passes through a nip between the heat roller 40 and the pressure roller 41, thereby the toner image is fixed on the printing sheet P.

Thereafter, the printing sheet P is conveyed such that it makes a U-turn as it proceeds upward, and discharged on the sheet discharge tray 32 formed on the top cover 4.

The printer 1 has a ventilation unit 60 inside the casing 2. The ventilation unit 60 is arranged, inside the casing 2, at an upper position of the rear part of the sheet tray 30 and below the black process unit 6K and the fixing unit 9. The ventilation unit 60 has a duct 62, a fan supporting frame 63, a fan 61 and a filter 70.

The duct 62 is arranged at a lower rear part with respect to the pressure roller 41. The duct 62 has a box-like shape extending in the right-and-left direction, and a right end surface thereof is opened. The duct 62 has a plurality of ventilation holes 62*a* on its surrounding surface.

The fan supporting frame 63 is arranged on the right side with respect to the duct 62 and the driving roller 26, and has an upper beam 91 and a lower beam 92.

The upper beam 91 extends in the front-and-rear direction. A rear end part of the upper beam 91 is secured to the right end part of the duct 62.

The lower beam 92 is arranged below the upper beam 91 and extends in the front-and-rear direction such that it extends in parallel with the upper beam 91.

The fan 61 is secured to rear end parts of the upper beam 91 and the lower beam 92. The fan 61 is arranged, inside the casing 2, at a right side portion such that the fan 61 contacts the duct 62 in the right-and-left direction and is located next to the heat roller 40 in the up-and-down direction. The fan 61 is arranged at a lower rear position of or below a second film 80 and the fixing unit 9, and relatively close to the fixing unit 9.

The filter 70 is secured on the upper beam 91 such that the filter 70 is arranged on the right side with respect to the black process unit 6K, and on the front side with respect to the fan 61. The filter 70 has a plate-like member fixed to the upper beam 91 along the front-and-rear direction such that a thickness direction of the filter 70 is along the up-and-down direction and a surface direction thereof extends in the front-and-rear direction. The filter 70 is configured to allow the air to pass in its thickness direction. The filter 70 is configured such that, when the air containing ozone generated inside the casing 2 passes therethrough, the ozone is removed by the filter 70.

The second film 80 is secured to the dividing wall 51. The second film 80 is a flexible resin film having a rectangular shape extending in the right-and-left direction when viewed from the up-and-down direction. A rear part of the second film 80 is secured to a lower end part of the dividing wall 51, and a front end part of the second film 80 elastically contacts the upper rear wall 73 of the drum container 71. With this configuration, the second film 80 inclines such that the font end part is located at a lower front position, while the rear end part is located at an upper rear position, and bridged between the dividing wall 51 and the upper rear wall 73. The second film 80, together with the dividing wall 51, divides a space on the black process unit 6K, including the second channel S2, and a space on a rear side with respect to the black process unit 6K, including the first channel S1.

A first channel S1 is a projection space which is a space corresponding to a projection of the second film 80 and the fixing frame 42 onto the duct 62. The first channel S1 is defined by the dividing wall 51, a second auxiliary dividing wall 96, the fixing frame 42 and the rear end part of the driving roller 26.

A second channel S2 is a space defined by the second film 80, the dividing wall 51, the reinforcing member 52, the first film 85 and the upper rear wall 73. The second channel S2 includes the filter 70 and a space inside the fan supporting frame 63. The second channel S2 is arranged next to the first channel via the second film 80.

As above, the second film 80 blocks a communication between the first channel S1 and the second channel S2.

When the fan 61 is actuated, an air flow occurs inside the casing 2, and the air inside the casing is discharged outside the casing through a discharge opening (not shown).

At this stage, a first air flow F1 directed from the fixing unit 9 toward the fan 61 is generated inside the first channel S1. Specifically, the high temperature air surrounding the heat roller 40 is caused to pass a portion around the pressure roller 41, be directed to the duct 62, and caused to enter the duct 62 via the plurality of ventilation holes 62*a*. The air entering the duct 62 flows from left to right and reaches the fan 61.

In the second channel S2, a second air flow F2 directed from the scorotron charger 17 to the fan 61 is generated. Specifically, the ozone generated as the scorotron charger 17 operates, together with the air around the scorotron charger 17, reaches the rear of the first film 85. Thereafter, the air flows from left to right such that the air flows along the second film 80 and the upper rear wall 73, and reaches a portion above the filter 70 which is located in a midway of the second channel S2. The air reaches the portion above the filter 70 and passes through the filter 70 along its thickness direction, flows inside the fan supporting frame 63 from front to rear therein, and reaches the fan 61.

In each of the process units 6 other than the black process unit 6K, a third air flow F4 directed from the scorotron charger 17 to the fan 61 is generated. Specifically, the ozone generated as the scorotron charger 17 operates, together with the air around the scorotron charger 17, flows to reach a portion in front of the adjacent process unit 6 located on the rear side. Then, the air flows from left to right, and then flows rearward and reaches a portion above the filter 70. The air reaches the portion above the filter 70. The third air flow F4 and the second air flow F2 join together, pass the filter 70 in the thickness direction, and reach the fan 61.

As above, the ozone generated due to operation of the scorotron chargers 17 passes through the filter 70 together with the air, thereby the ozone is removed by the filter 70.

Then, the first air flow F1, the second air flow F2 and the third air flow F4 directed to the fan 61 are discharged from the casing 2 as an air flow F3.

According to the first embodiment described above, the second film 80 is located between the first channel S1 and the second channel S2. The second film 80 blocks communication between the first channel S1 and the second channel S2. Therefore, it is possible to suppress that the first air flow F1 and the second air flow F2 join together. Further, the filter 70 is disposed in the midway of the second channel S2. Therefore, by simply introducing the ozone which is generated as the scorotron chargers 17 operate in the second channel S2, the ozone can be removed by the filter 70.

As shown in FIGS. 1 and 2, the fan 61 is arranged at the right side portion inside the casing 2. Further, the second channel S2 is formed to extend in the right-and-left direction to incorporate a channel in which the air flows from the left side to the right side. Therefore, it is possible to form the second channel S2 to extend along the upper front wall 77 and upper rear wall 73 of the drum container 71. Therefore, according to the first embodiment, the second channel S2 can be formed with a relatively simple structure.

As shown in FIG. 2, since the fan 61 and the filter 70 are arranged on the right side parts inside the casing 2, the ozone generated due to operations of the scorotron chargers 17 is collected rightward with use of the fan 61 and removed by causing the ozone to pass through the filter 70. Therefore, the ozone can be removed efficiently.

As shown in FIGS. 1 and 2, the second film 80 has an elongated rectangular shape extending in the right-and-left direction and is configured to be flexible. Therefore, it is possible to make the second film 80 elastically bend and contact the upper rear wall 73. As a result, communication between the first channel S1 and the second channel S2 can be well blocked with the second film 80.

As shown in FIGS. 1 and 2, the second film 80 is provided to the dividing wall 51. Accordingly, it is possible to keep the second film 80 at a constant position. As a result, blocking of communication between the first channel S1 and the second channel S2 with the second film 80 is ensured, and joining of the first air flow F1 and the second air flow F2 can be well suppressed.

<Modification of First Embodiment>

According to the first embodiment, the second film 80 is secured to the dividing wall 51. The invention needs not be limited to this configuration, and can be modified such that the second film 80 is secured to the upper rear wall 73. Specifically, a front end part of the second film 80 may be secured to the upper rear wall 73 and a rear end part of the second film 80 may elastically contact a lower end part of the dividing wall 51.

According to the above configuration, since the second film 80 is secured to the upper rear wall 73, the second film 80 can be attached to the upper rear wall 73 when the black process unit 6K is detached from the casing 2. Thus, the second film 80 can be secured easily.

<Second Embodiment>

Figure 3:
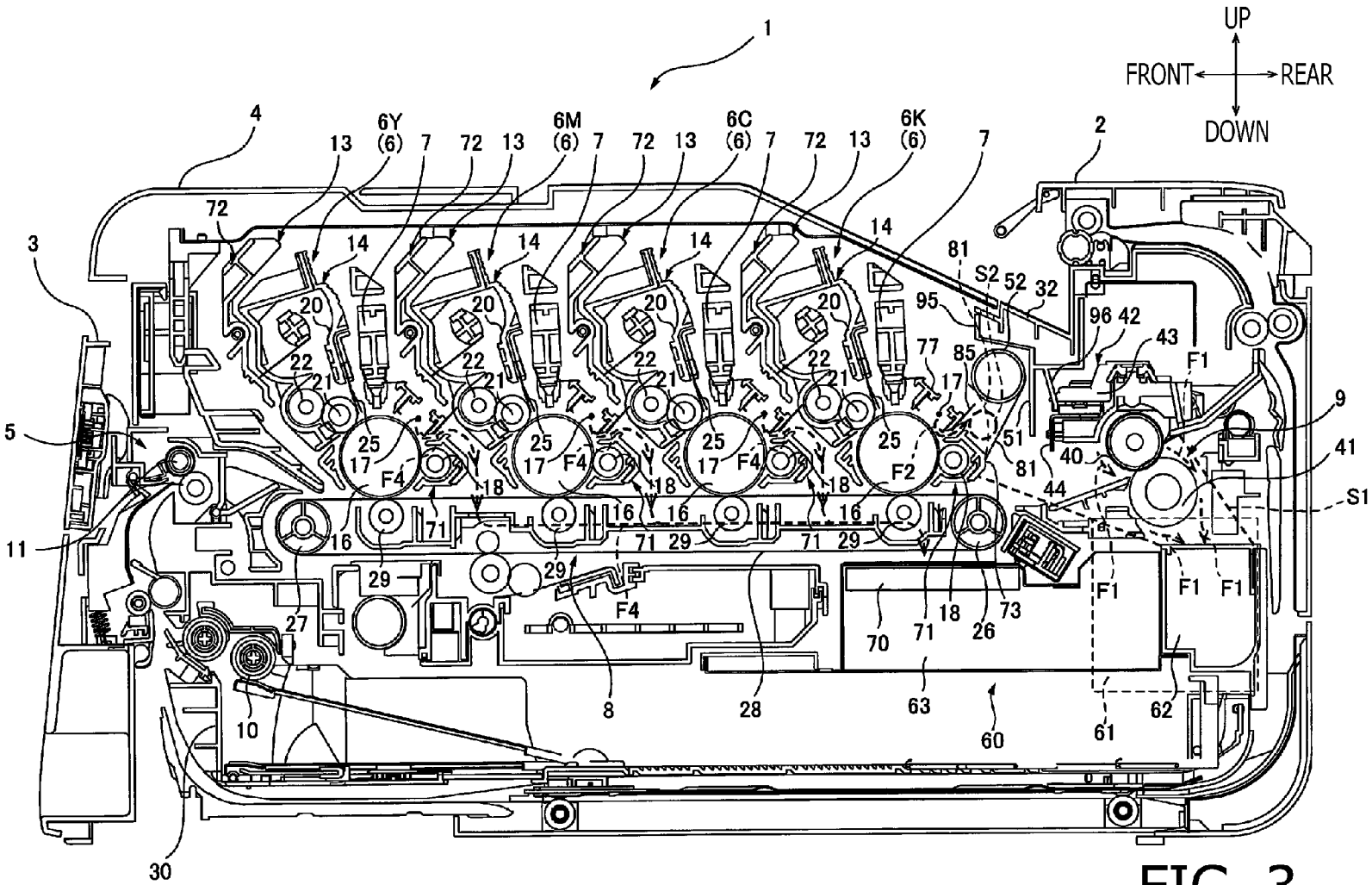
FIG. 3 is a cross-sectional side view of a printer according to a second embodiment of the invention.

Hereinafter, a second embodiment of the invention will be described. It is noted that, in FIG. 3, members/elements similar to those referred to in the first embodiment are assigned with the same reference numbers and description thereof will not be repeated for brevity.

According to the first embodiment, the second film 80 is secured to the dividing wall 51. According to the second embodiment, a third film 81 is secured to the reinforcing member 52 instead of the second film 80 of the first embodiment.

The third film 81 is a flexible resin film, and has a substantially rectangular shape extending in the right-and-left direction when viewed from the up-and-down direction. A rear end part of the third film 81 is secured to the rear end part of the reinforcing member 52. A front end part of the third film 81 elastically contacts the upper rear wall 73 of the drum container 71. With this configuration, the third film 81 is arranged to be inclined such that the front end is located at a lower front position while the rear end is located at an upper rear position, and bridged between the upper rear wall 73 and the reinforcing member 52.

As above, according to the second embodiment, the second channel S2 is defined by the third film 81, the reinforcing member 52, the first film 85 and the upper rear wall 73.

The third film 81 blocks communication between the first channel 51 and the second channel S2.

According to the above configuration of the second embodiment, it is possible to locate the third film 81 at a constant position. As a result, blocking of the communication between the first channel S1 and the second channel S2 with use of the third film 81 is ensured, and joining of the first air flow F1 and the second air flow F2 can be well suppressed.

<Modification of Second Embodiment>

According to the second embodiment, the third film 81 is secured to the reinforcing member 52. The invention needs not be limited to such a configuration, and can be modified in various ways. For example, the third film 81 may be secured to the upper rear wall 73 instead of the reinforcing member 52. Specifically, as shown by dotted lines in FIG. 3, the lower end part of the third film 81 may be secured to the upper rear wall 73 and the upper end part of the third film 81 may elastically contact the front end part of the reinforcing member.

With the above configuration, since the third film 81 contacts the front end part of the reinforcing member 52, the second channel S2 can be appropriately defined.

<Third Embodiment>

Hereinafter, a third embodiment of the invention will be described. It is noted that, in FIG. 4, members/elements similar to those referred to in the foregoing description are assigned with the same reference numbers and description thereof will not be repeated for brevity.

Figure 4:
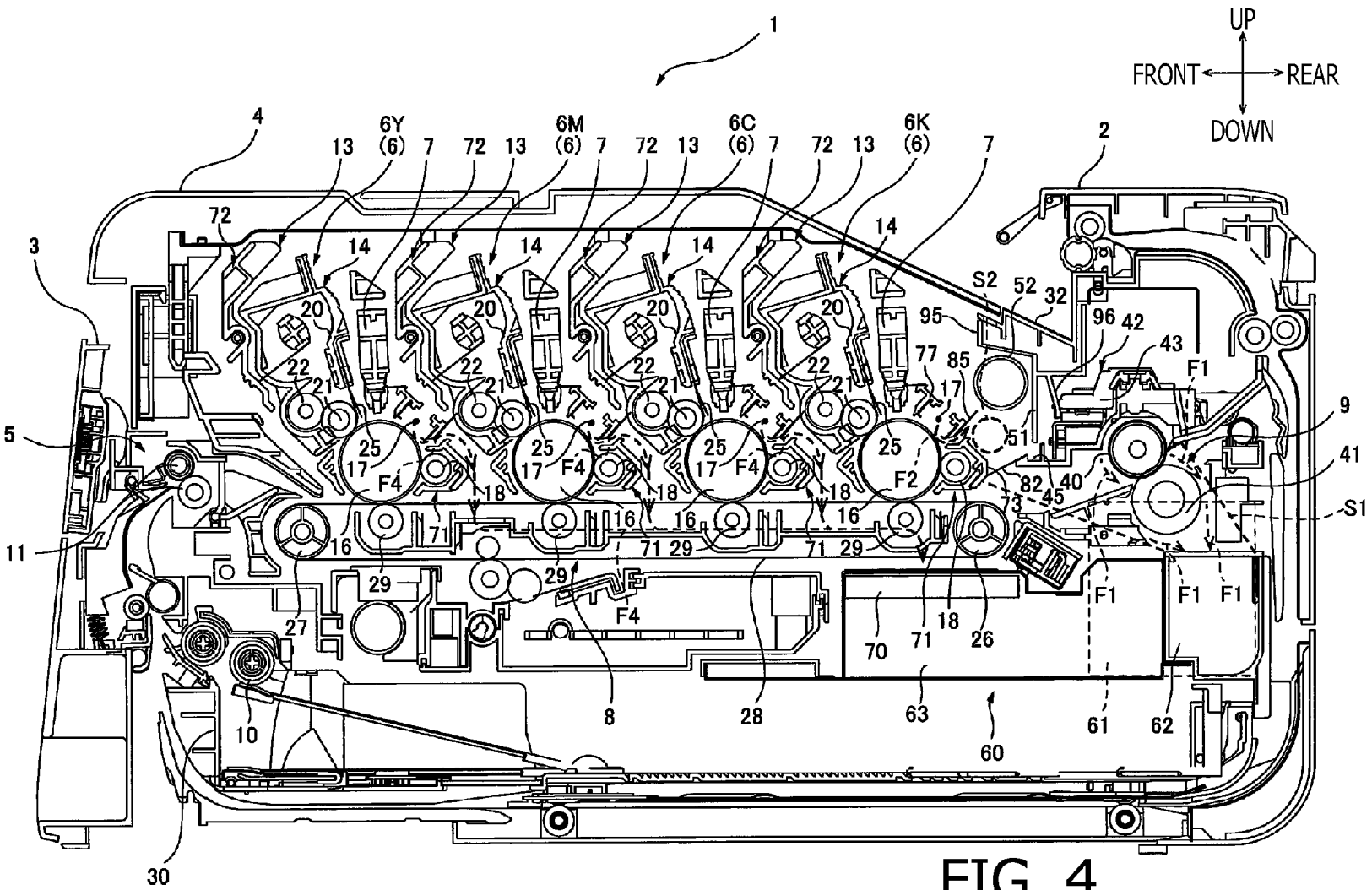
FIG. 4 is a cross-sectional side view of a printer according to a third embodiment of the invention.

According to the first embodiment, the rear end part of the second film 80 is secured to the dividing wall 51 and the front end part of the second film 80 elastically contacts the upper rear wall 73. According to a third embodiment, as shown in FIG. 4, a front end of a fourth film 82 is secured to the upper rear wall 73 and a rear end part of the fourth film 82 contacts the fixing frame 42, instead of employing the second film 80.

According to the third embodiment, the fixing frame 42 has a protruding plate 45. The protruding plate 45 is a plate-like member extending in the right-and-left direction. The protruding plate 45 protrudes frontward from a front end of the upper cover 43, and a front end part of the protruding plate 45 is located on a rear side of the upper rear wall 73 with a space therebetween.

The fourth film 82 is a flexible resin film and a substantially rectangular shape extending in the right-and-left direction when viewed from the up-and-down direction. A front end part of the fourth film 82 is secured to the upper rear wall 73, while a rear end part of the fourth film 82 elastically contacts the front end part of the protruding plate 45. With this configuration, the fourth film 82 inclines such that a front end part thereof is located at a lower front position while a rear end part is located at an upper rear position so that the fourth film 82 is bridged between the upper rear wall 73 and the protruding plate 45.

According to the third embodiment, the second channel S2 is defined by the fourth film 82, the fixing frame 42, the second auxiliary dividing wall 96, the dividing wall 51, the reinforcing member 52, the first film 85 and the upper rear wall 73.

As above, the fourth film 82 blocks communication between the first channel S1 and the second channel S2.

According to the above configuration, since the fourth film 82 contacts the fixing frame 42, the first channel S1 and the fixing frame 42 can be defined in an integrated manner.

<Modification of Third Embodiment>

According to the third embodiment, the fourth film 82 is secured to the upper rear wall 73. The invention needs to be limited to such a configuration, but can be modified in various ways. For example, the fourth film 82 may be secured to the protruding plate 45. Specifically, the rear end part of the fourth film 82 may be secured to a rear end part of the protruding plate 45, while the front end part of the fourth film 82 may elastically contact the upper rear wall 73.

According to the above configuration, similar to the first embodiment, the fourth film 82 can be located at a constant position. As a result, blocking of communication between the first channel S1 and the second channel S2 can be ensured and joining of the first air flow F1 and the second air flow F2 can be well suppressed.

What is claimed is:

1. An image forming apparatus, comprising:

a main body casing;

a drum unit including a photoconductive drum having a central axis extending in a first direction, and a charging device configured to charge the photoconductive drum;

a fixing unit arranged adjacent to the drum unit and configured to fix an image on a printing medium;

a fan configured to generate an air flow inside the main body casing;

a filter configured to remove ozone included in the air passing therethrough;

a first channel defined in the main body casing, the air directed from the fixing unit toward the fan flowing in the first channel;

a second channel defined in the main body casing, the air directed from the charging device toward the fan flowing in the second channel, the filter being provided in the second channel, the second channel being arranged next to the first channel; and a blocking member configured to block communication between the first channel and the second channel, one end of the blocking member is fixed to a portion of the main body casing on a downstream side, in a feeding direction of the printing medium, with respect to the drum unit, and on an upstream side with respect to the fixing unit, while the other end of the blocking member contacts the drum unit, wherein the one end of the blocking member and the other end of the blocking member are arranged on a same side with respect to a sheet conveying path.

2. The image forming apparatus according to claim 1, wherein:

the fan is located at one side portion in the first direction in the main body casing; and the second channel includes a channel which extends in the first direction and in which the air flows from another side in the first direction to the one side.

3. The image forming apparatus according to claim 2, wherein the filter is located at the one side in the first direction within the second channel.

4. The image forming apparatus according to claim 2, wherein the blocking member is a flexible member and has an elongated shape extending in the first direction.

5. The image forming apparatus according to claim 4, wherein the blocking member is a resin film.

6. The image forming apparatus according to claim 5, wherein the main body casing has an inner wall, the resin film disposed between the drum unit and the inner wall.

7. The image forming apparatus according to claim 1, wherein:

the image forming apparatus has multiple units of the drum unit, the multiple units being arranged in a second direction which is perpendicular to the first direction; and the fixing unit is arranged to be next to one of the multiple units located at an end in the second direction.

8. The image forming apparatus according to claim 7, wherein the multiple units are detachably attached to the main body casing.

9. The image forming apparatus according to claim 1, wherein the blocking member is provided to the drum unit.

10. The image forming apparatus according to claim 1, wherein the blocking member is provided to the main body casing.

11. The image forming apparatus according to claim 1, wherein the blocking member is provided to the fixing unit.

12. An image forming apparatus, comprising a plurality of drum units arranged at intervals in a predetermined direction, each drum unit having a photoconductive drum having a central axis extending in a first direction perpendicular to the predetermined direction and a charging device configured to charge the photoconductive drum, the charging device having a charger frame;

a fixing unit configured to fix an image on a printing medium and arranged adjacent to the plurality of drum units in the predetermined direction;

a main body casing accommodating the plurality of drum units and the fixing unit therein and having an inner frame disposed between a first drum unit of the plurality of drum units and the fixing unit in the predetermined direction;

a flexible member having a first end portion and a second end portion opposite to the first end portion, the first end portion in contact with the charger frame and the second end portion in contact with the inner frame, one end of the flexible member is fixed to a portion of the main body casing on a downstream side, in a feeding direction of the printing medium, with respect to the first drum unit, and on an upstream side with respect to the fixing unit, while the other end of the flexible member contacts the first drum unit, wherein the one end of the flexible member and the other end of the flexible member are arranged on a same side with respect to a sheet conveying path.

13. The image forming apparatus according to claim 12, wherein the flexible member is a resin film.

14. The image forming apparatus according to claim 12, wherein the main body casing has an upper wall, the inner frame extending in a third direction from the upper wall, the third direction is upper-and-down direction perpendicular both to the predetermined direction and to the second direction from the upper wall.

15. The image forming apparatus according to claim 12, wherein the main body casing has a first side wall and a second side wall in the second direction, the inner frame bridging the first side wall and the second side wall.

16. The image forming apparatus according to claim 12, wherein the fixing unit has a fixing frame, the inner frame protruding from a fixing frame.

17. The image forming apparatus according to claim 12, further comprising a fan configured to generate an air flow inside the main body casing and disposed at one side in the predetermined direction in the main body casing.

18. The image forming apparatus according to claim 12, further comprising a filter configured to remove ozone included in the air passing therethrough and disposed at the one side in the predetermined direction in the main body casing.

19. The image forming apparatus according to claim 18, wherein the fan is arranged next to the filter in the second direction, the fan is closer to the fixing unit than the filter.

* * * * *